US011118788B2

(12) United States Patent
Sevilla

(10) Patent No.: US 11,118,788 B2
(45) Date of Patent: Sep. 14, 2021

(54) INSTANT HOT WATER SYSTEM CONTROL PANEL

(71) Applicant: Edmond Alejandro Sevilla, Smyrna, GA (US)

(72) Inventor: Edmond Alejandro Sevilla, Smyrna, GA (US)

( * ) Notice: Subject to any disclaimer, the term of this patent is extended or adjusted under 35 U.S.C. 154(b) by 0 days.

(21) Appl. No.: 15/456,532

(22) Filed: Mar. 12, 2017

(65) Prior Publication Data

US 2019/0226687 A1 Jul. 25, 2019

(51) Int. Cl.

| | |
|---|---|
| ***F24D 17/00*** | (2006.01) |
| ***F24H 7/00*** | (2006.01) |
| ***F24H 9/14*** | (2006.01) |
| ***F24H 9/20*** | (2006.01) |
| ***F24D 19/10*** | (2006.01) |

(52) U.S. Cl.

CPC ..... *F24D 17/0078* (2013.01); *F24D 19/1051* (2013.01); *F24H 7/00* (2013.01); *F24H 9/14* (2013.01); *F24H 9/2007* (2013.01)

(58) Field of Classification Search

CPC .... F24D 17/0078; F24D 19/1051; F24H 9/14; F24H 9/2007; F24H 7/00

See application file for complete search history.

(56) References Cited

U.S. PATENT DOCUMENTS

| | | | | |
|---|---|---|---|---|
| 2,786,162 | A * | 3/1957 | Ballou | H02B 1/056 361/634 |
| 3,989,986 | A * | 11/1976 | Farley | H02B 1/21 361/605 |
| 4,346,357 | A * | 8/1982 | Kussy | H01H 89/06 335/16 |
| 5,261,443 | A * | 11/1993 | Walsh | F24D 17/0078 122/13.3 |
| 5,829,467 | A * | 11/1998 | Spicher | F24D 17/0078 137/14 |
| 5,839,655 | A * | 11/1998 | Iritani | F24D 19/1012 237/8 A |
| 2009/0266426 | A1* | 10/2009 | Lee | F24D 17/0078 137/337 |
| 2012/0017367 | A1* | 1/2012 | Reeder | E03C 1/057 4/597 |
| 2013/0247997 | A1* | 9/2013 | Ng | F24H 1/107 137/13 |
| 2013/0327410 | A1* | 12/2013 | Acker | F24H 9/2007 137/13 |
| 2018/0180303 | A1* | 6/2018 | Kellicker | E03B 7/04 |

* cited by examiner

*Primary Examiner* — Steven S Anderson, II

(57) ABSTRACT

The instant hot water system CONTROL PANEL for new homes is an on-demand controller for a common residential water pump, installed at the hot water supply/recirculation hot water pipe line back to the regular residential gas or electric water heater, with push button switches in every bathroom, kitchen, laundry room etc. to pump hot water at the touch of said button; from the water heater to faucets throughout the house and dispense the hot water to the user, with no waiting time and very minimal cold water waste down the drain because the hot water has already reached every single faucet in the house as the users with the push of a button demanded it.

3 Claims, 3 Drawing Sheets

INSTANT HOT WATER SYSTEM CONTROL PANEL

CROSS-REFERENCE TO RELATED APPLICATIONS

N/A

STATEMENT REGARDING FEDERALLY SPONSORED RESEARCH OR DEVELOPMENT

N/A

THE NAMES OF THE PARTIES TO A JOINT RESEARCH AGREEMENT

N/A

BACKGROUND OF THE INVENTION

Field of the Invention

The subject matter of the subject matter disclosed herein is concerned with improved hot water systems with short hot water delivery times.

Description of Related Art Including Information Disclosed Under 37 CFR 1.97 and 1.98

Walsh, U.S. Pat. No. 5,261,443, Nov. 16, 1993, discloses a water recirculating system having an electronic control unit. Water from a water supply source enters a cold water feed line which feeds cold water to cold water tap(s). There is a T connection in the cold water feed line to feed cold water to a hot water heater. A hot water feed line supplies hot water to a hot water tap(s). A pump s disposed in the cold water feed line between the T connection and cold water tap. If there are multiple pairs of cold and hot water taps, the cold and hot water feel lines include branches to feed all of the taps in the system wherein each pair of taps at any particular destination may be, for example hot and cold water taps at a sink or bath tub. There is a conduit between hot and cold water feed lines feeding each destination. Each conduit has a thermally activated switch controlling a valve. When the pump is activated, the direction of cold water flow in the cold water feed line is reversed. This has the effect of rerouting cold water from the c old water taps to the hot water heater while allowing cool water from the hot water feed line to feed the reverse flow of water in the cold water feed line. A thermally activated switch shuts down the system when the water from the hot water feed line near each hot water tap reaches a predetermined temperature.

Iritani, U.S. Pat. No. 5,839,655, Nov. 24, 1998, discloses a hot water heating system which has a pump which draws hot water from a hot water heatingtank and feeds hot water to a return pipe which returns water to the hot water heating tank. The system is designed to direct hot water from the hot water heating tank to radiators or to bypass the radiators. A pump is disposed in a supply pipe between the hot water heating tank and the radiators. Hot water flowing from the radiators or bypassing the radiators is routed back to the hot water heating tank via the return pipe.

BRIEF SUMMARY OF THE INVENTION

The instant hot water system and control panel, FIG. 1, is a system that is installed in a new home by the time of construction, in combination with small common residential use water pump and push button switches installed in every bathroom, kitchen, laundry room or any room where a sink or faucet is installed. The system supplies on demand hot water anytime the user needs it at a point of use that uses hot water. A point of use may include hot water faucets, bathroom sinks, kitchen sinks, laundry sinks, shower heads, shower faucets, bathtub faucets and whirlpool faucets. A pump positioned near a hot water heater directs hot water in a hot water supply line to one or more points-of-use via a branch or branches. The first branch upstream of the pump is denoted as the first branch. While the pump is pumping, water in the hot water supply the line recirculates any unused water to the hot water heater by means of a hot water return line. A user operating a switch at a room having a point of use can activate the pump. If the water in the hot water supply line is cool or cold, the user needs only to activate a push button switch and wait for a short time interval for the cool or cold water to be cleared from the hot water supply line, thereby making hot water almost instantly available when the hot water tap is opened.

BRIEF DESCRIPTION OF THE SEVERAL VIEWS OF THE DRAWING(S)

INDEX OF REFERENCE NUMERALS

Figure 1:
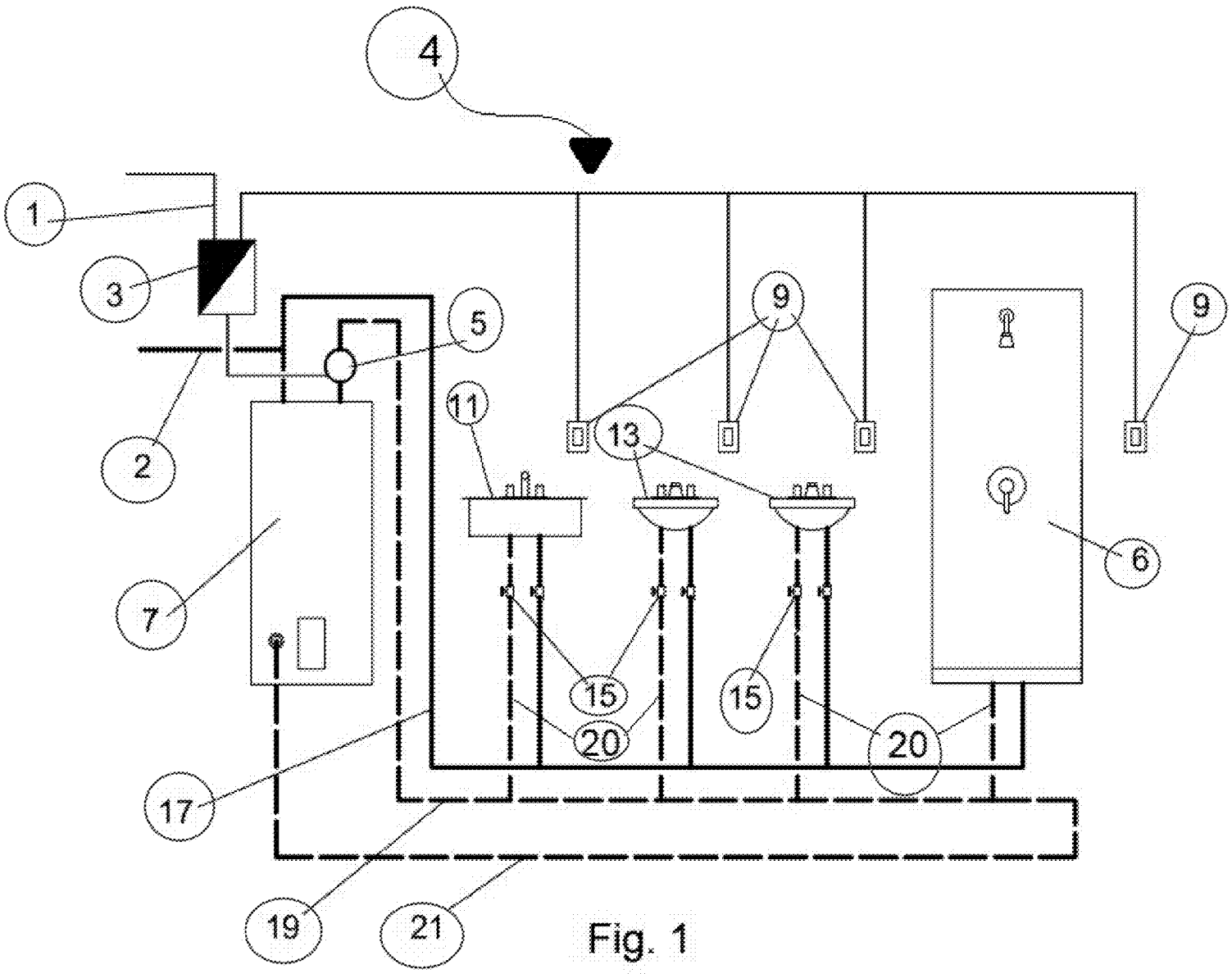
FIG. 1 is a schematic diagram of the instant hot water system and control panel.
Figure 2:
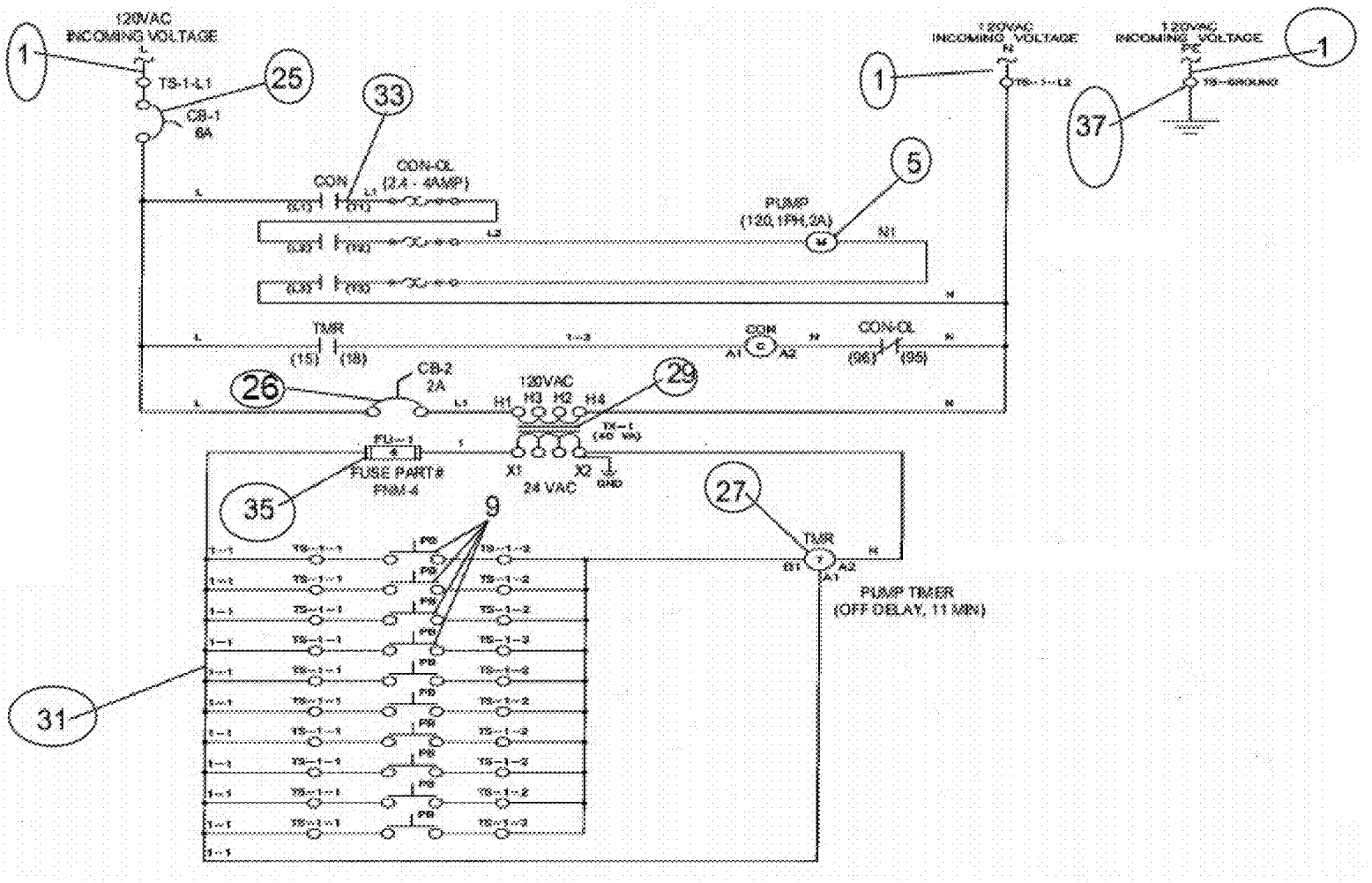
FIG. 2 is a wiring schematic drawing for the instant hot water system and control panel.
Figure 3:
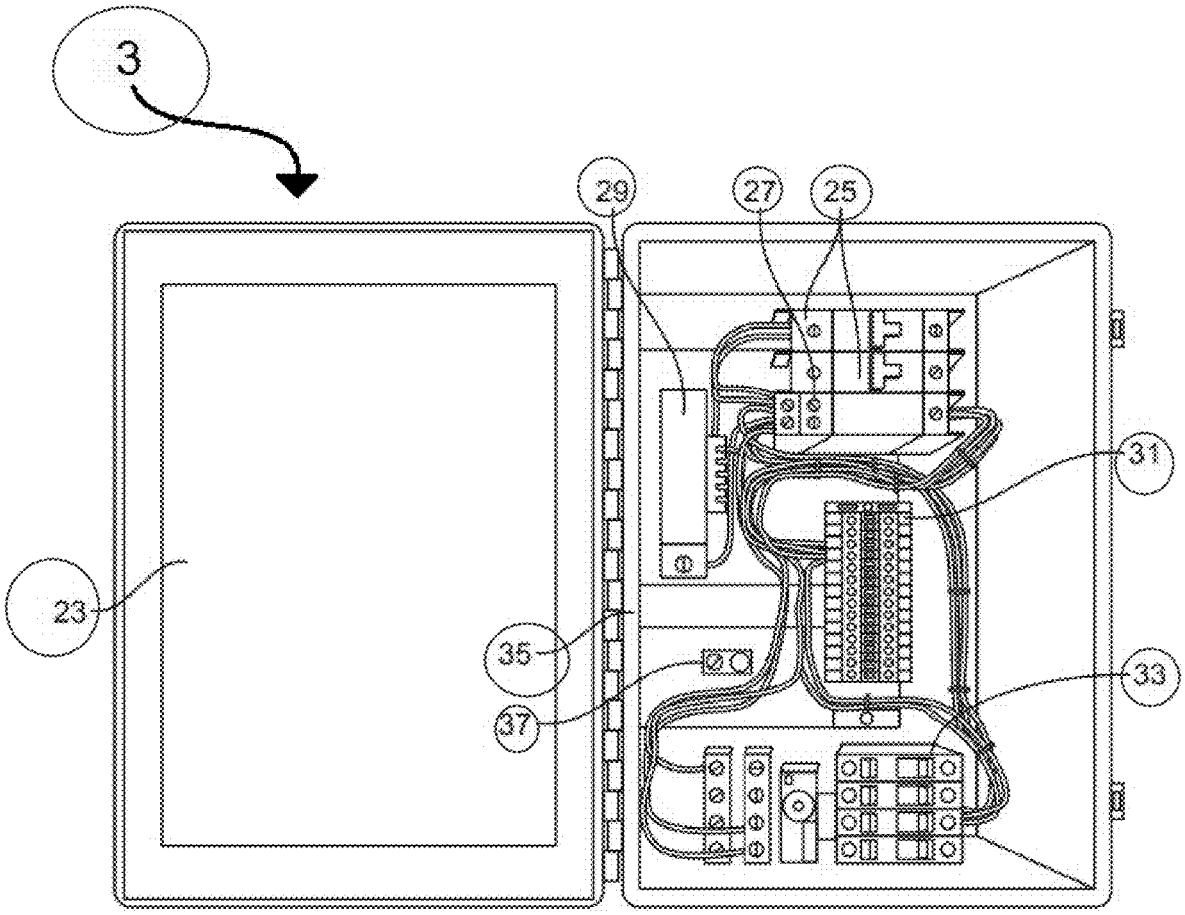
FIG. 3 is a front view of the control panel.

1. Electrical supply
2. Cold water supply
3. Control panel
4. System
5. Water pump
6. Shower
7. Water heater
8. Instant hot water system and control panel
9. Push button switches
11. Kitchen sink
13. Sink (bathroom, laundry, etc.)
15. Water supply shut-off valve
17. Cold water supply line
19. Hot water supply line
20. Hot water supply line branches
21. Hot water return line
23. Panel enclosure
25. First circuit breaker
26. Second circuit breaker
27. Timer
29. Transformer 120 V-24 V
31. Terminal block and power feed L1(L), L2(N)
33. Electrical contactor-overload
35. Fuse FU-1
37. Ground terminal

DETAILED DESCRIPTION OF THE INVENTION

The instant hot water system and control panel 8 is a system that is installed in a new home by the time of construction, in combination with small common residential use water pump and push button switches installed in every bathroom, kitchen, laundry room or any room where a kitchen sink 11, sink 13 or faucet is installed, supplies on demand hot water anytime the user needs it.

Referring to FIG. 1, push button switches 9 are installed in every bathroom, kitchen, or room where faucets or shower are installed. A water pump 5 is installed in the hot water supply line 19 of the regular residential gas or electric water heater 7. A user can activate the water pump 5 by pushing any one of the push-button switches 9. When the pump 5 is activated, hot water flows from the hot water heater through a hot water supply line 19, which runs throughout the house, to a hot water return line 21. The hot water return line is configured to pass as close as possible to each bathroom sink, kitchen sink, laundry sink, shower faucet, bathtub faucet, whirlpool faucet. The hot water supply line has branches 20 which distribute hot water to each point-of-use. The hot water return line recirculates water back to the heater. After the pump is switched on a timer keeps the pump on for a selected time with an adjustable timer. After the pump is switched off, it may be restarted by the user or any other person in the house nearby one of the push button switches 9.

Before opening the valve of a hot water faucet, a user would first activate the pump using one the push button switches. After a brief waiting period that is usually no longer than 11-16 seconds for an average size home, the user simply opens the faucet hot water valve to have hot water nearly instantly available. If the system is not operated or used by the user, it will not interfere with the operation of the water heater to provide hot water.

Definitions

The term, point of use, shall include hot water faucets, bathroom sinks, kitchen sinks, laundry sinks, shower heads, shower faucets, bathtub faucets and whirlpool faucets.

I claim:

1. In a household hot water system, a control panel comprising, an enclosure, a timer, a transformer, a terminal block and power feed, an electrical contactor, a fuse, a first circuit breaker, a second circuit breaker, and a ground terminal, pushbutton switches, said pushbutton switches electrically connected to said control panel, wherein each bathroom, kitchen, laundry room, or any room in which a sink is installed having one of said pushbutton switches, a 120 VAC incoming voltage, said control panel receiving electrical power from said incoming voltage, said contactor, said timer, and said second circuit breaker electrically connected to said first circuit breaker, said pump indirectly connected to said first circuit breaker via said contactor, said transformer electrically connected to said second circuit breaker, said pump timer and said terminal block electrically connected to said transformer with said fuse disposed between said terminal block and said transformer, said pump timer positioned between said transformer and said terminal block, said pushbutton switches connected to said terminal block, said control panel adapted to control hot water flowing through the hot water system wherein the hot water system has a hot water supply line, the hot water supply line having branches which supply hot water to said each bathroom, kitchen, laundry room, or any room in which a sink is installed, a pump positioned on the hot water supply line upstream of the branches wherein said pump receiving hot water from the hot water heater, a hot water return line, the hot water return line configured to return unused water from the hot water supply line to the water heater, said control panel further adapted to activate said pump for an adjustable time period when one of said push-button switches is depressed, said timer configured to switch off said pump after said adjustable time period following pump activation, wherein said pump then remains off until reactivated when one of said push-button switches is subsequently depressed, whereby hot water is delivered to the room in which the one of the pushbutton switches was depressed.

2. An instant hot water system comprising, a hot water heater, a hot water supply line, said hot water supply line having branches, the branches configured to supply hot water to each bathroom, kitchen, laundry room, or any room in which a sink is installed, a pump, said pump positioned downstream of said hot water heater and upstream of said branches, a hot water return line, said hot water return line adapted to receive water from said hot water supply line and to return unused water from said hot water supply line to said heater, pushbutton switches, said pushbutton switches located in each of said bathroom, kitchen, laundry room, or any room in which a sink is installed, a control panel, said control panel adapted to respond to depression of any one of said pushbutton switches, said control panel further adapted to activate said pump for an adjustable time period in response to a signal due to depression of any of said pushbutton switches, said control panel further adapted to maintain the pump in an active state for said adjustable time period, wherein said pump then remains off until reactivated when one of the pushbutton switches is subsequently depressed.

3. A household hot water system comprising, a control panel, said control panel having, an enclosure, a timer, a transformer, a terminal block and power feed, an electrical contactor, a fuse, a first circuit breaker, a second circuit breaker, and a ground terminal, pushbutton switches, said pushbutton switches electrically connected to said control panel, with each pushbutton switch disposed at a bathroom, kitchen, laundry room, or any room in which a sink is installed, a 120 VAC incoming voltage, said contactor, said timer, and said second circuit breaker electrically connected to said first circuit breaker, said pump indirectly connected to said first circuit breaker via said contactor, said transformer electrically connected to said second circuit breaker, said pump timer and said terminal block electrically connected to said transformer with said fuse disposed between said terminal block and said transformer, said pump timer positioned between said transformer and said terminal block, said pushbutton switch or said plurality of pushbutton switches connected to said terminal block, said control panel adapted to control hot water flowing through the hot water system wherein the hot water system has a hot water supply line, the hot water supply line having branches which supply hot water to said each bathroom, kitchen, laundry room, or any room in which a sink is installed, a pump positioned on the hot water supply line upstream of the branches wherein said pump receiving hot water from the hot water heater, a hot water return line, the hot water return line configured to return unused water from the hot water supply line to the water heater, said control panel further adapted to activate said pump for an adjustable time period when one of said pushbutton switches is depressed, said timer configured to switch off said pump after said adjustable time period following pump activation, wherein said pump then remains off until reactivated when said pushbutton switch or said plurality of pushbutton switches is again depressed.

* * * * *